US005159737A

United States Patent [19]

Kimura et al.

[11] Patent Number: 5,159,737

[45] Date of Patent: Nov. 3, 1992

[54] DUST COLLECTION APPARATUS

[75] Inventors: Hiroyoshi Kimura, Shizuoka; Shinroku Nishiyama, Hyougo, both of Japan

[73] Assignee: Nippon Metal Co., Ltd., Osaka, Japan

[21] Appl. No.: 787,266

[22] Filed: Nov. 4, 1991

Related U.S. Application Data

[63] Continuation-in-part of Ser. No. 417,421, Oct. 5, 1989, abandoned.

[30] Foreign Application Priority Data

Oct. 5, 1988 [JP] Japan ..... 63-130807

[51] Int. Cl.[5] ..... A47L 5/38

[52] U.S. Cl. ..... 15/314; 15/312.1; 15/315; 98/115.4; 285/185

[58] Field of Search ..... 15/312.1, 314, 315, 15/340.1; 98/115.4; 285/184, 185

[56] References Cited

U.S. PATENT DOCUMENTS

| | | | |
|---|---|---|---|
| 2,772,438 | 12/1956 | Diaz | 15/340.1 X |
| 3,150,404 | 9/1964 | Johnson | 15/339 |
| 3,506,998 | 4/1970 | Perry | 15/339 |
| 3,594,898 | 7/1971 | Atkinson | 15/340.1 X |
| 4,019,219 | 4/1977 | Willenborg | 15/340.1 X |
| 4,379,548 | 4/1983 | Boshoven | 98/115.4 X |
| 4,540,202 | 9/1985 | Amphoux et al. | 15/314 X |
| 4,699,046 | 10/1987 | Bellieni | 98/115.4 |
| 4,860,644 | 8/1989 | Kohl et al. | 285/184 X |

*Primary Examiner*—Chris K. Moore

*Attorney, Agent, or Firm*—Wenderoth, Lind & Ponack

[57] ABSTRACT

A dust collection apparatus comprising a base duct, an adapter duct rotatably mounted on the upper end of the base duct, a first duct arm pivotaly connected to the upper end of the adapter duct and made of steel plates, a first connecting mechanism for connecting the adapter duct and the first duct arm, and second drive means for swinging the first duct arm. The first connecting mechanism comprises cylindrical holders projecting from the adapter duct, two branches of substantially U-shape provided with openings in which the cylindrical holders are inserted rotatably, air tight seals positioned between the openings of the branches and the cylindrical holders, a shaft penetrating the two branches and the adapter duct for rotatably connecting the first duct arm to the adapter duct, and support means arranged in the adapter duct for supporting the shaft.

3 Claims, 4 Drawing Sheets

DUST COLLECTION APPARATUS

This application is a continuation-in-part of now abandoned application Ser. No. 07/417,421 filed Oct. 5, 1989.

BACKGROUND OF THE INVENTION (1) Field of the Invention

The present invention relates to a dust collection apparatus and more particularly to such a dust collection apparatus which sucks dust, odors or gas generated in a factory, and discharges same outside.

(2) Description of the Prior Art

Conventionally, in a factory where dust was generated, a number of discharge fans, which were mounted on the walls of a building of the factory, discharged the dust outside directly or via ducts.

However, in a case of a welding factory, welding locations generating dust, ordors or gas were ordinary dispersed therein.

Therefore, it could not obtain an effective dust proof for welders who were working at places between the welding locations generating dust and gas and the walls of the factory where the discharge fans were positioned. To solve such a problem, it was proposed such a dust collection system that a collection duct was installed independently at the dust and gas generating locations so as to suck the generated dust and gas immediately and discharge same outside via a main suction pump. The collection duct had to include such a construction that it could approach the welding place and be remote away therefrom according to welding conditions. For the purpose, it was proposed that the collection duct was constructed by utilizing a flexible hose of plastices. In this case, the hose was mounted on a support arm which was fixed on a carrier (for instance, U.S. Pat. No. 3,150,404) or a floor of the factory and extended upward.

In the welding factory, however, since the plastice hose sucked sparks and fumes or griding powder, it was easily damaged and could not be used for a long time. Further, when such a dust collection system was large sized for increasing a collection capacity, the support arm could not support a heavy hose and the support arm itself had to be large sized. As the result, there occurred a problem that the collection system per se became larger and larger.

The inventor proposed a duct collection apparatus in Japanese Utility Model Application No. 63-130807, wherein a plurality of metal ducts were disposed to be bendable by utilizing a mechanism like a magic-hand without using a support arm and a plastic hose. This dust collection apparatus comprised as follows. A suction duct connected to a suction pump was connected to a base duct which was fixed on a floor to stand thereon. A rotatable duct was connected rotatably to the base duct and driven by means of a hydraulic cylinder. A first duct arm was pivoted on the upper portion of the rotatable duct so as to be swingable up and down about a horizontal axis. The first duct arm was driven to swing by means of a hydraulic cylinder which was attached to the rotatable duct with one end thereof and to the first duct arm with another end thereof. The forward end of the first duct arm may be bent at a predetermined angle and a second duct arm was pivoted on the forward end of the first duct arm to be able to swing up and down about a horizontal axis. The second duct arm was swung by means of a hydraulic cylinder which was mounted on the first duct arm with one end thereof and the second duct arm with another end thereof. The duct could be close to and remote away from the welding locations within a range covered by operations of the rotatable duct and the first and second duct arms. A hood arm was connected to a forward end of the second duct arm to extend in a direction vertical to a longitudinal direction of the second duct arm and it is constructed to keep its desired rotated positions.

The dust collection apparatus solved a problem raised in a conventional dust collection apparatus which used a support arm and a plastic hose. However, there should be provided respectively a rotatable connection between the rotatable duct, the first and second duct arms, the second duct arm and the hood arm, forming a suction passage therethrough. Further, the second duct arm had to support a weight of the hood arm and the first duct arm had to support weights of the second duct arm and the hood arm. Also, the rotatable duct had to support all of the weights of the first and second duct arms and the hood arm. Of course, an effective discharge could be secured by decreasing an air resistance in the duct. However, the connecting portions between these arms connect the walls of the arms which were faced and rotatably contacted to one another. Therefore, the duct could be deformed due to a weight load acting on the connecting portions and as the result a smooth rotation could not be obtained for these arms unless the duct was made by a heavy and strong steel plate.

Further, such an arm deformation caused a decrease of a suction effect since clearances were formed and widened around the pivots for connecting the arms to one another. For solving the problem, it could provide ribs for reinforcing the connecting portions. However, this construction lowered a suction effect since the ribs increased an air resistance in the duct.

SUMMARY OF THE INVENTION

The present invention has an object to improve a connecting mechanism of a dust collection apparatus which comprises a plurality of metal ducts which are connected bendably to one another, so as to make an air resistance in the duct minimum while connecting the ducts strongly.

To achieve the object, the dust collection apparatus according to the present invention comprises a base duct having a lower end adapted to be connected to a vaccum source, and an upper end, an adapter duct having a lower end rotatably mounted on the upper end of the base duct about a vertical axis and an upper end, first drive means for rotating the adapter duct, a first duct arm having a lower end and an upper end formed to be two branches respectively, said first duct arm being pivotaly connected to the upper end of the adapter duct to swing up and down about a horizontal axis and formed substantially rectangular in cross section and made of steel plates, a first connecting mechanism for connecting the adapter duct and the first duct arm, second drive means for swinging the first duct arm, a second duct arm having a base end pivotally connected to the upper end of the first duct arm and a forward end, a second connecting mechanism for connecting the first duct arm and the second duct arm, third drive means for swinging the second duct arm, a hood arm having a base end connected to the forward end of the second duct arm and a forward end opened for suction, and a third connecting mechanism for connecting the second duct arm and the hood arm, characterized in that the first connecting mechanism comprises cylindrical holders projecting from the adapter duct in a horizontal direction to have suction passages therein communicating with a suction passage of the adapter duct, two branches of substantially U-shape formed with the lower end of the first duct arm and having suction passages therein, said each branch being provided with an opening in which the cylindrical holder is inserted rotatably, air tight means positioned between each of the openings of the branches and the cylindrical holders, a shaft penetrating the two branches and the adapter duct along a common axis of the cylindrical holders for rotatably connecting the first duct arm to the adapter duct while communicating the suction passages of the two branches with the passages of the adapter duct, and support means arranged in the adapter duct for supporting the shaft.

According to the dust collection apparatus of this invention, although the adapter duct and the first duct arm are made of relatively thin metal plates, the first duct arm may be supported strongly by utilizing the construction of the cylindrical holders and the two branches of the first duct arm without provision of any reinforcing parts except the shaft in the connecting portions while allowing rotation or swing of the first duct arm. There is, however, no problem in providing the shaft since it is originally hard and not easily damaged by sparks, grinding powders and so forth even if it is rotated or not. Therefore, the sucked air including dust, sparks and fumes may flow smoothly from the first duct arm to the adapter duct via the two branches and the cylindrical holders without decreasing a flow rate of the sucked air or increasing an air resistance in the connecting portions.

Further, according to the connecting mechanism of this invention, where the apparatus becomes large sized, the connecting portions of the adapter duct and the first duct arm could not be deformed and made to widen clerances around the shaft or the connecting portions due to increase of the weights of the first and second duct arms and the hood arm and therefore it could prevent a suction effect of the apparatus from lowering.

Other objects and advantages of this invention will be apparent from the following description with reference to the drawings.

BRIEF DESCRIPTION OF THE DRAWINGS

The drawings show an embodiment of a dust collection apparatus according to the present invention in which.

DETAILED DESCRIPTION OF THE EMBODIMENT

Figure 1:
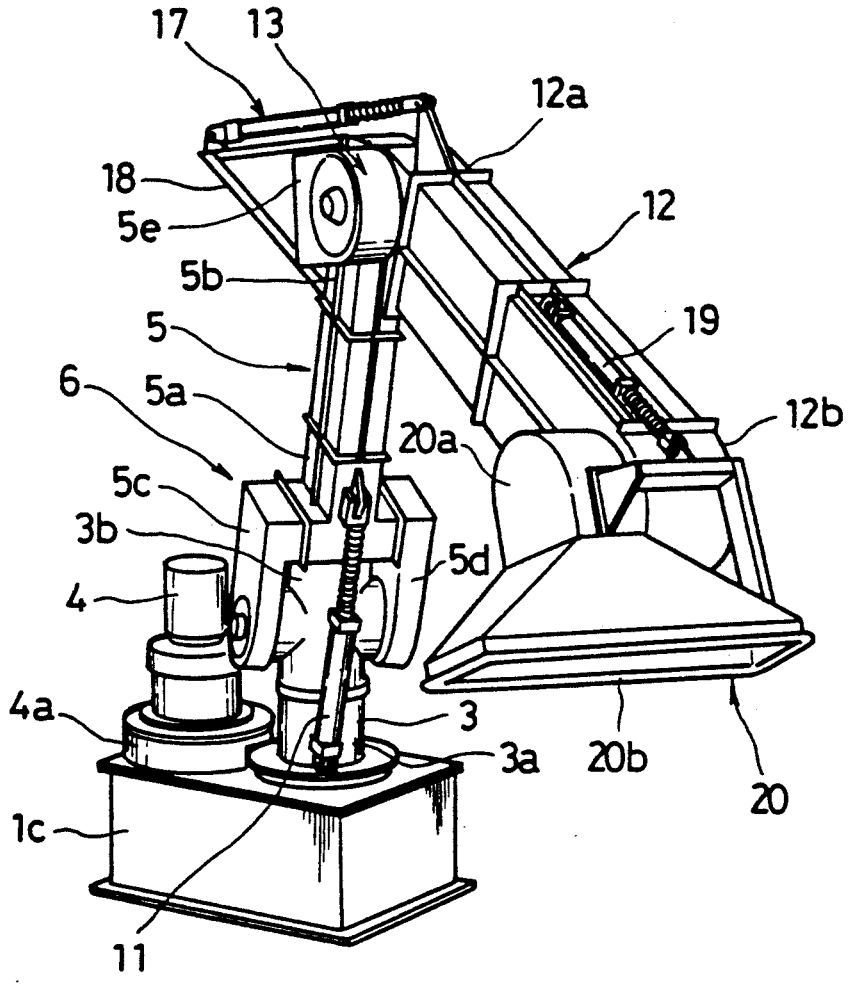
FIG. 1 is a perspective view of the apparatus.
Figure 2:
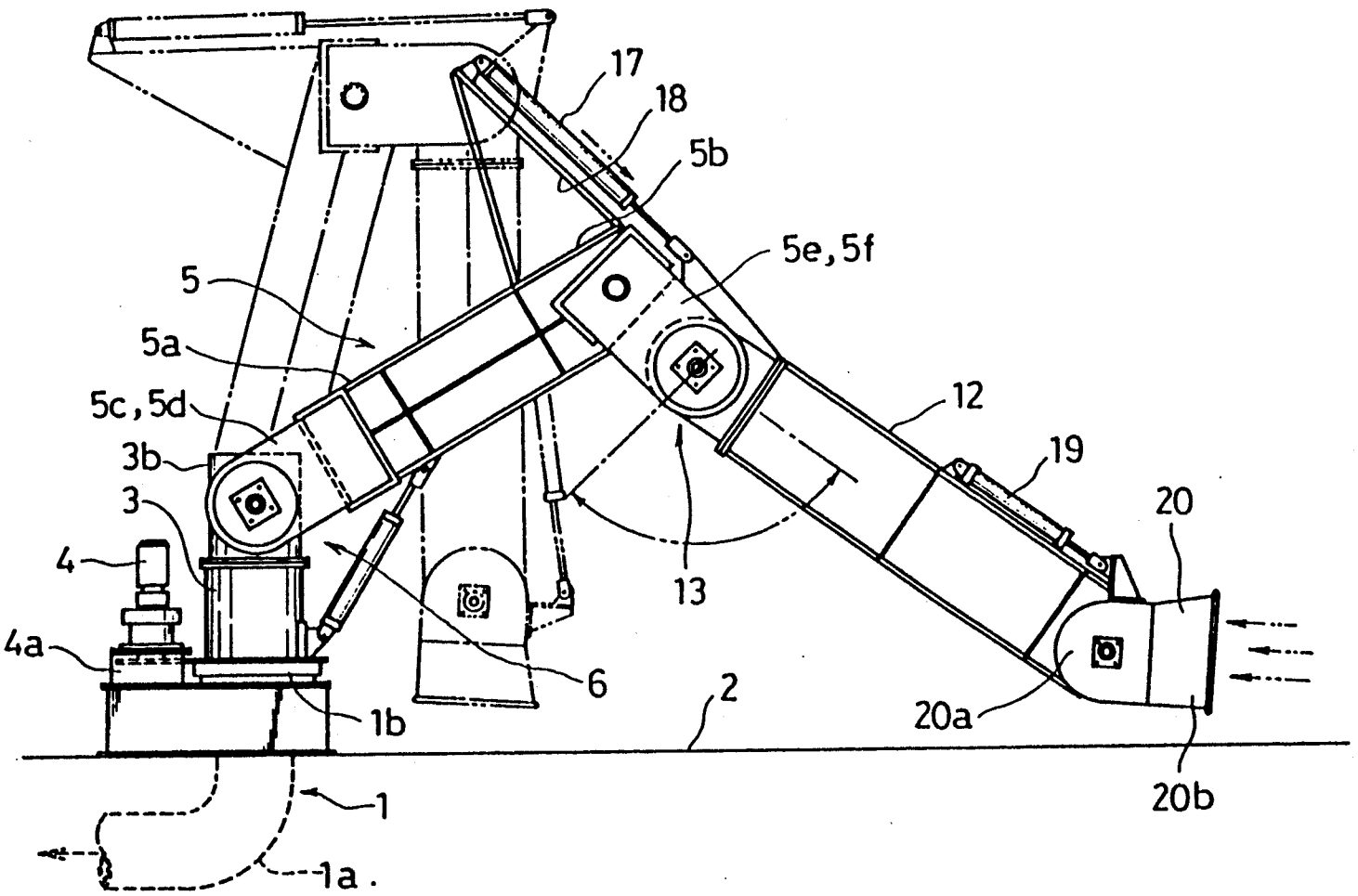
FIG. 2 is a side view of the apparatus showing an operation thereof with phantom lines.
Figure 3:
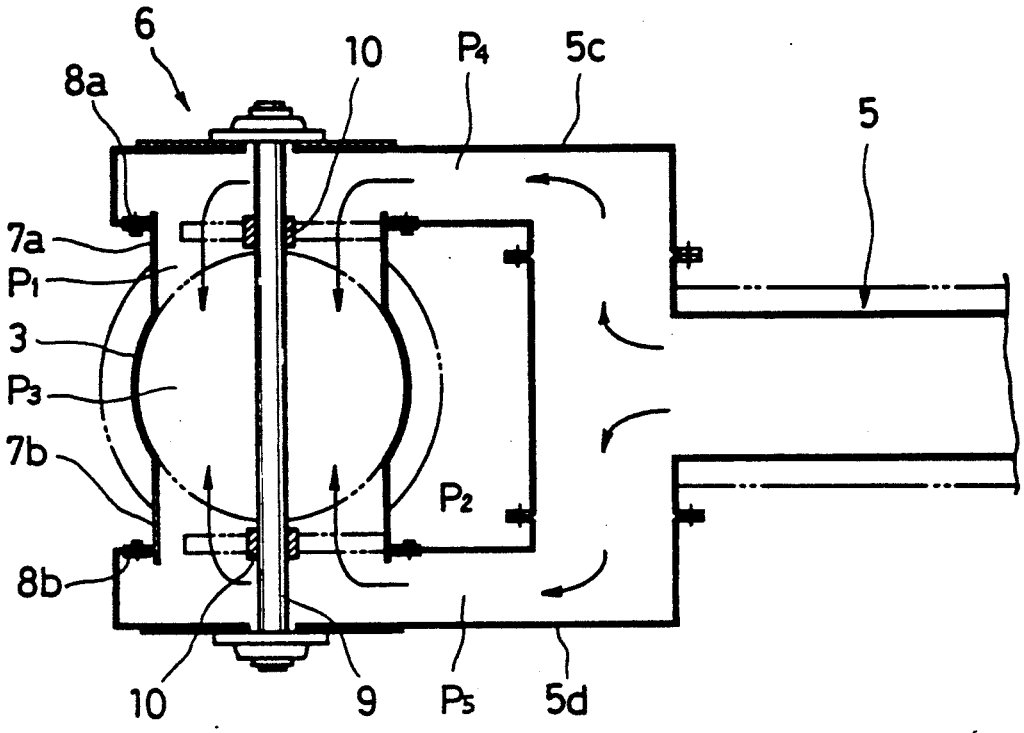
FIG. 3 is a cross sectional view showing a connecting mechanism between an adapter duct and a first duct arm.
Figure 4:
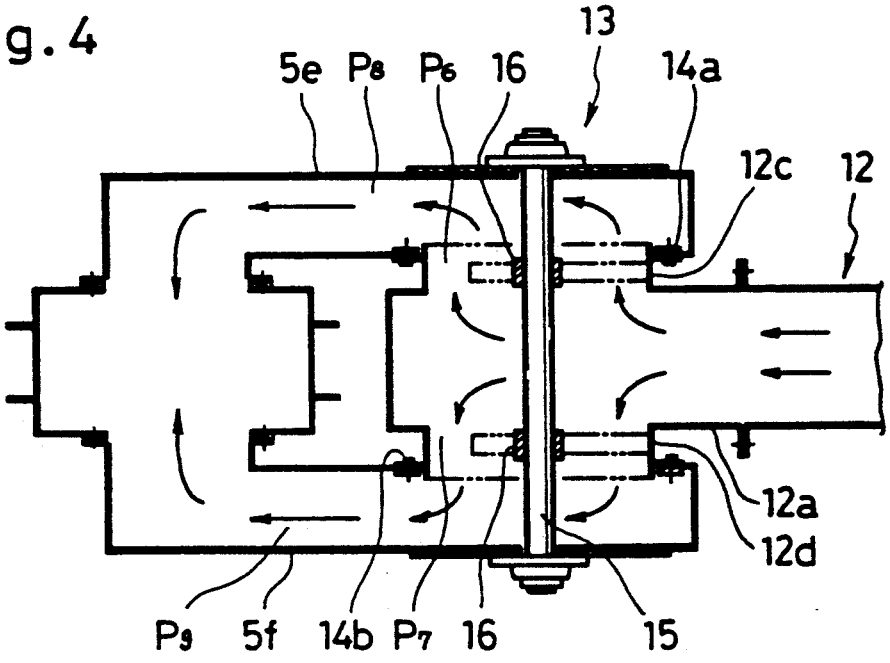
FIG. 4 is a cross sectional view showing a connecting mechanism between the first duct arm and a second duct arm.
Figure 5:
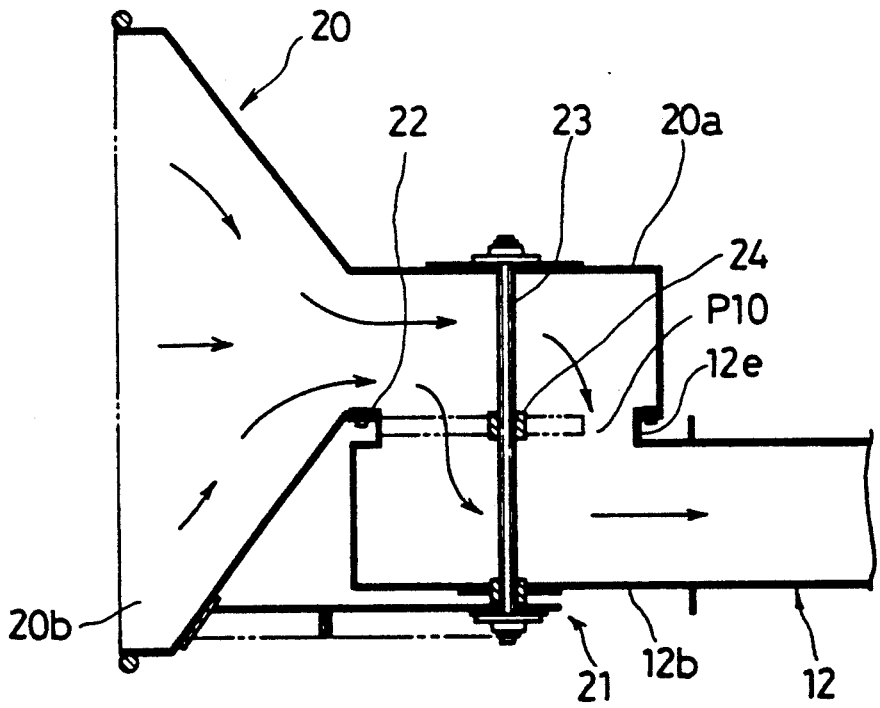
FIG. 5 is a cross sectiional view showing a connecting mechanism between the second duct arm and a hood arm.

As seen in FIG. 1, a dust collection apparatus comprises as follows. A base duct 1 has a lower end 1*a* and an upper end 1*b*, and the lower end 1*a* is adapted to be connected to a vaccum source which is not shown but ordinary comprises a suction pump. The base duct 1 is normally positioned under a floor 2 or a ground of for example a welding factory and it projects with the upper end 1*b* from the floor 2 and provides a base box 1*c* on the floor 2.

An adapter duct 3 has a lower end 3*a* and an upper end 3*b*, and the lower end 3*a* is rotatably mounted on the upper end 1*b* of the base duct 1 about a vertical axis. An electric motor 4 as first drive means is monted on the base box 1*c* for rotating the adapter duct 3 by means of a gear mechanism 4*a*. The electric motor 4 may be substituted for drive means including a hydraulic cylinder.

A first duct arm 5 has a lower end 5*a* and an upper end 5*b* both of which are formed to be two branches 5*c*, 5*d*, 5*e* and 5*f*, respectively. The first duct arm 5 is rotatably connected to the upper end 3*b* of the adapter duct 3 to swing up and down about a horizontal axis and formed substantially rectangular in cross section and made of relatively thin steel plates.

A first connecting mechanism 6 is provided for connecting the adapter duct 3 and the first duct arm 5. The first connecting mechanism 6 comprises cylindrical holders 7*a* and 7*b* projecting from the adapter duct 3 in a horizontal direction to have suction passages P1 and P2 therein, said passages P1 and P2 being communicated with a suction passage P3 of the adapter duct 3. The two branches 5*c* and 5*d* of substantially U-shape are formed with the lower end 5*a* of the first duct arm 5 and provide suction passages P4 and P5 therein. Each of the branches 5*c* and 5*d* is provided with an opening in which the cylindrical holder 7*a* or 7*b* is inserted rotatably.

Rubber seal plates 8*a* and 8*b* in a shape of a ring are positioned as air tight means between each of the openings of the branches 5*c* and 5*d* and the cylindrical holders 7*a* and 7*b*. The rubber seal plates 8*a* and 8*b* are fixed to the first duct arm 5 and extend to fit the peripheries of the cylindrical holders 7*a* and 7*b* for making a seal therebetween. There is no problem that a small clearance is formed respectively between the edges of the rubber seal plates 8*a* and 8*b* and the peripheries of the cylindrical holders 7*a* and 7*b* since such a small clearance does not lower a suction effect due to an air leak therefrom.

A shaft 9 is positioned to penetrate the two branches 5*c* and 5*d* and the adapter duct 3 along a common axis of the cylindrical holders 7*a* and 7*b* for rotatably connecting the first duct arm 5 to the adapter duct 3 while communicating the suction passages P4 and P5 of the two branches 5*c* and 5*d* with the suction passage P3 of the adapter duct 3. A pair of shaft supporters 10 as support means are arranged in the adapter duct 3 for supporting the shaft 9. The shaft 9 is normally rotatable relative to the shaft supporters 10, but it is possible that the shaft 9 is fixed to the shaft supporters 10 and the two branches 5*c* and 5*d* may be mounted rotatably around the shaft 9 and the cylindrical holders 7*a* and 7*b*.

A hydraulic cylinder 11 as second drive means is mounted for swinging the first duct arm 5 up and down in such a state that a forward end of a piston rod of the hydraulic cylinder 11 is pivoted to the lower end 5*a* of the first duct arm 5 and a cylinder thereof is pivoted to the lower end 3*a* of the adapter duct 3.

A second duct arm 12 has a base end 12*a*, and a forward end 12*b* and said base end 12*a* is pivotally connected to the upper end 5*b* of the first duct arm 5.

A second connecting mechanism 13 is provided for connecting the first duct arm 5 and the second duct arm 12. The second connecting mechanism 13 comprises cylindrical holders 12*c* and 12*d* projecting from the base end 12*a* of the second duct arm 12 in horizontal direction to have suction passages P6 and P7. The two branches 5*e* and 5*f* substantially U-shape are formed with the upper end 5*b* of the first duct arm 5, and have suction passages P8 and P9 therein. Each of the branches 5*e* and 5*f* is provided with an opening in which the cylindrical holder 12*c* or 12*d* is inserted rotatably. Further, the branches 5*e* and 5*f* have an angle of 110~120 degrees with respect to a longitudinal axis of the first duct arm 5.

Rubber seal plates 14*a* and 14*b* in a shape of a ring are positioned as air tight means between each of the openings of the branches 5*e* and 5*f* and the cylindrical holders 12*a* and 12*b*.

The rubber seal plates 14*a* and 14*b* are fixed to the branches 5*e* and 5*f* and extend to fit the peripheries of the cylindrical holders 12*a* and 12*b* for making a seal therebetween.

A shaft 15 is positioned to penetrate the two branches 5*e* and 5*f* and the second duct arm 12 along a common axis of the cylindrical holders 12*a* and 12*b* for rotatably connecting the second duct arm 12 to the first duct arm 5 while communicating the suction passages P6 and P7 of the cylindrical holders 12*a* and 12*b* with the passages P8 and P9 of the two branches 5*e* and 5*f*.

A pair of shaft supporters 16 as support means are arranged in the cylindrical holders 12*a* and 12*b* for supporting the shaft 16. The shaft 16 is normally rotatable relative to the shaft supporters 10, but it may be mounted in the same manner as that of the shaft 9.

A hydraulic cylinder 17 as third drive means is mounted for swinging the second duct arm 12 up and down in such a state that a forward end of a piston rod of the hydraulic cylinder 17 is pivoted to the base end 12*a* of the second duct arm 12 and a base end of a cylinder thereof is pivoted to the upper end 5*b* of the first duct arm 5 via a lever arm 18.

A hood arm 20 has a base end 20*a* rotatably connected to the forward end 12*b* of the second duct arm 12, and a forward end 20*b* opened widely for suction, A hydraulic cylinder 19 as fourth drive means is provided for swinging the hood arm 20 up and down about a horizontal axis.

A third connecting mechanism 21 is provided for connecting the second duct arm 12 and the hood arm 20. The third connecting mechanism 21 comprises a cylindrical holder 12*e* projecting from the forward end 12*b* of the second duct arm 12 in horizontal direction to have a suction passage P10. The base end 20*a* has an opening in which the cylindrical holder 12*e* is inserted rotatably.

A rubber seal plate 22 in a shape of a ring is positioned as air tight means between the opening of the base end 20*a* and the cylindrical holder 12*e*. The rubber seal plate 22 is fixed to the base end 20*a* and extend to fit the periphery of the cylindrical holder 12*e* for making a seal therebetween.

A shaft 23 is positioned to penetrate the forward end 12*b* of the second duct arm 12 and the base end of the hood arm 20 along a common axis of the hood aem 20 and the cylindrical holder 12*e*.

A shaft supporter 24 as support means are arranged in the cylindrical holder 12*e* for supporting the shaft 23. The shaft 23 is normally rotatable relative to the shaft supporter 24, but it may be mounted in another manner which is referred to in the case of the shaft 10.

What is claimed is:

1. A dust collection apparatus comprising a base duct having a lower end adapted to be connected to a vacuum source, and an upper end, an adapter duct having a lower end rotatably mounted on the upper end of the base duct about a vertical axis and an upper end, first drive means for rotating the adapter duct, a first duct arm having a lower end and an upper end formed to be two branches respectively, said first duct arm being pivotally connected to the upper end of the adapter duct to swing up and down about a horizontal axis and formed substantially rectangular in cross section and made of steel plates, a first connecting mechanism for connecting the adapter duct and the first duct arm, second drive means for swinging the first duct arm, a second duct arm having a base end pivotally connected to the upper end of the first duct arm and a forward end, a second connecting mechanism for connecting the first duct arm and the second duct arm, third drive means for swinging the second duct arm, a hood arm having a base end connected to the forward end of the second duct arm and a forward end opened for suction, and a third connecting mechanism for connecting the second duct arm and the hood arm, characterized in that:

the first connecting mechanism comprises cylindrical holders projecting from the adapter duct in a horizontal direction to have suction passages therein communicating with a suction passage of the adapter duct, two branches of substantially U-shape formed with the lower end of the first duct arm and having suction passages therein, said each branch being provided with an opening in which the cylindrical holder is inserted rotatably, air tight means positioned between each of the openings of the branches and the cylindrical holders, a shaft penetrating the two branches and the adapter duct along a common axis of the cylindrical holders for rotatably connecting the first duct arm to the adapter duct while communicating the suction passages of the two branches with the passage of the adapter duct, and support means arranged in the adapter duct for supporting the shaft.

2. The dust collection apparatus of claim 1, wherein the second connecting mechanism comprises cylindrical holders projecting from the second duct arm in a horizontal direction to have suction passages therein communicating with a suction passage of the first duct arm, two branches of substantially U-shape formed with the upper end of the first duct arm and having suction passages therein, said each branch being provided with an opening in which the cylindrical holder is inserted rotatably, air tight means positioned between each of the openings of the two branches and the cylindrical holders, a shaft penetrating the two branches and the second duct arm along a common axis of the cylindrical holders for rotatably connecting the second duct arm to the first duct arm while communicating the suction passages of the two branches with the passage of the adapter duct, and support means arranged in the cylndrical holders for supporting the shaft.

3. The dust collection apparatus of claim 2, wherein the third connecting mechanism comprises a cylindrical holder projecting from the forward end of the second duct arm in a horizontal direction to have a suction passage therein communicating with a suction passage of the hood arm, said cylindrical holder being rotatably inserted in an opening formed with the base end of the hood arm, air tight means positioned between the opening of the base end of the hood arm and the periphery of the cylindrical holder, a shaft penetrating the forward end of the second duct arm and the base end of the hood arm along a common axis thereof for rotatably connecting the second duct arm to the hood arm while communicating the suction passage of the cylindrical holder with the passage of the hood arm, and support means arranged in the cylindrical holder for supporting the shaft.

* * * * *